US008573230B2

(12) United States Patent
Zhuang et al.

(10) Patent No.: US 8,573,230 B2
(45) Date of Patent: Nov. 5, 2013

(54) SMOKING ARTICLE WITH COAXIAL TOBACCO ROD

(75) Inventors: Shuzhong Zhuang, Richmond, VA (US); Georgios D. Karles, Richmond, VA (US); Raquel M. Olegario, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 1645 days.

(21) Appl. No.: 11/636,585

(22) Filed: Dec. 11, 2006

(65) Prior Publication Data

US 2007/0137667 A1 Jun. 21, 2007

Related U.S. Application Data

(60) Provisional application No. 60/749,100, filed on Dec. 12, 2005.

(51) Int. Cl.
*A24C 5/32* (2006.01)
*A24C 5/34* (2006.01)

(52) U.S. Cl.
USPC ..... 131/280; 131/342; 131/360; 131/338; 131/344; 131/339

(58) Field of Classification Search
None
See application file for complete search history.

(56) References Cited

U.S. PATENT DOCUMENTS

| | | | | |
|---|---|---|---|---|
| 4,924,886 | A | 5/1990 | Litzinger | |
| 5,275,859 | A | 1/1994 | Phillips et al. | |
| 5,439,011 | A * | 8/1995 | Schneider | 131/360 |
| 5,549,125 | A * | 8/1996 | White | 131/342 |
| 5,611,360 | A | 3/1997 | Tang | |
| 5,730,160 | A | 3/1998 | Schneider | |
| 5,954,061 | A | 9/1999 | Cardarelli | |
| 5,979,459 | A | 11/1999 | Schneider | |
| 6,067,995 | A | 5/2000 | Schneider et al. | |
| 6,089,238 | A | 7/2000 | Schneider et al. | |
| 6,257,243 | B1 | 7/2001 | Müller et al. | |
| 6,827,087 | B2 | 12/2004 | Wanna et al. | |
| 2004/0074507 | A1 | 4/2004 | MacAdam et al. | |
| 2004/0094171 | A1 | 5/2004 | Wanna et al. | |
| 2004/0094172 | A1 | 5/2004 | Wanna et al. | |
| 2004/0261807 | A1 | 12/2004 | Dube et al. | |
| 2005/0066986 | A1 * | 3/2005 | Nestor et al. | 131/364 |

FOREIGN PATENT DOCUMENTS

| | | |
|---|---|---|
| EP | 0503461 A1 | 9/1992 |
| EP | 0693258 A1 | 1/1996 |
| GB | 1228747 A | 4/1971 |

OTHER PUBLICATIONS

International Search Report and Written Opinion dated Jun. 28, 2007 for PCT/IB2006/004078.

* cited by examiner

*Primary Examiner* — Richard Crispino
*Assistant Examiner* — Phu Nguyen
(74) *Attorney, Agent, or Firm* — Buchanan Ingersoll & Rooney PC

(57) ABSTRACT

A smoking article having a cylindrical tube of smokable material having an outer wrapper, a concentric rod of smokable material coaxially positioned within the cylindrical tube of a smokable material, and an inner wrapper separating the cylindrical tube and the concentric rod. A filter attaches to the tobacco rod with an annular film positioned between the filter and the tobacco rod. The annular film increases the resistance-to-draw of the cylindrical tube during smoking.

21 Claims, 1 Drawing Sheet

SMOKING ARTICLE WITH COAXIAL TOBACCO ROD

RELATED APPLICATIONS

This application claims priority under 35 U.S.C. 119 to U.S. Provisional Application No. 60/749,100 entitled COAXIAL TOBACCO ROD WITH GAS OR SEMI-IMPERMEABLE ANNULAR FILM ON THE MOUTH END and filed on Dec. 12, 2005, the entire content of which is hereby incorporated by reference.

BACKGROUND

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. The tobacco rod is generally between 6.0 and 10.0 millimeters in diameter and 40 millimeters and 125 millimeters in length. Typically, the filter includes a plug of cellulose acetate tow attached to the tobacco rod by tipping paper. Ventilation of mainstream smoke can be achieved with a row or rows of perforations about a location along the filter.

SUMMARY

In view of the tendency for cigarettes to have greater filtering efficiency and higher levels of dilution, there has arisen a need for a smoking article having a structure that better controls the tar concentration in the mainstream smoke, enhances the transfer of flavor and tar diluents, minimizes the migration of flavor and aerosol formers in the tobacco rod, and controls the composition of the side-stream smoke. In addition, it would be desirable that the smoking article burns comparable to a conventional cigarette during static burning.

In accordance with one embodiment, a smoking article comprises: a smoking article comprising: a tobacco rod comprising: a cylindrical tube of smokable material having an outer wrapper; a concentric rod of smokable material coaxially positioned within the cylindrical tube of a smokable material; and an inner wrapper separating the cylindrical tube and the concentric rod; a filter attached to the tobacco rod; and an annular film positioned between the filter and the tobacco rod, wherein the annular film is adapted to increase the resistance-to-draw of the cylindrical tube.

In accordance with another embodiment, a smoking article comprises: a smoking article comprising: a tobacco rod comprising: a cylindrical tube of smokable material having an outer wrapper; a concentric rod of smokable material coaxially positioned within the cylindrical tube of a smokable material; and a semi-impermeable inner wrapper separating the cylindrical tube and the concentric rod; a filter attached to the tobacco rod; and a semi-impermeable annular film positioned between the filter and the tobacco rod.

In accordance with a further embodiment, a method of making a smoking article, comprises the steps of: forming a tobacco rod portion of the smoking article by placing a smokable material within a semi-impermeable inner wrapper, and a cylindrical tube of smokable material around the semi-impermeable inner wrapper and having an outer wrapper; providing a filter; placing a semi-impermeable annular film positioned between the filter and the tobacco rod, wherein the annular film is adapted to decrease airflow drawn through the cylindrical tube as compared to the airflow drawn through the concentric rod; and joining the tobacco rod portion in end-to-end relationship with the filter such that the annular film is positioned between the tobacco rod and the filter.

DETAILED DESCRIPTION

Figure 1:
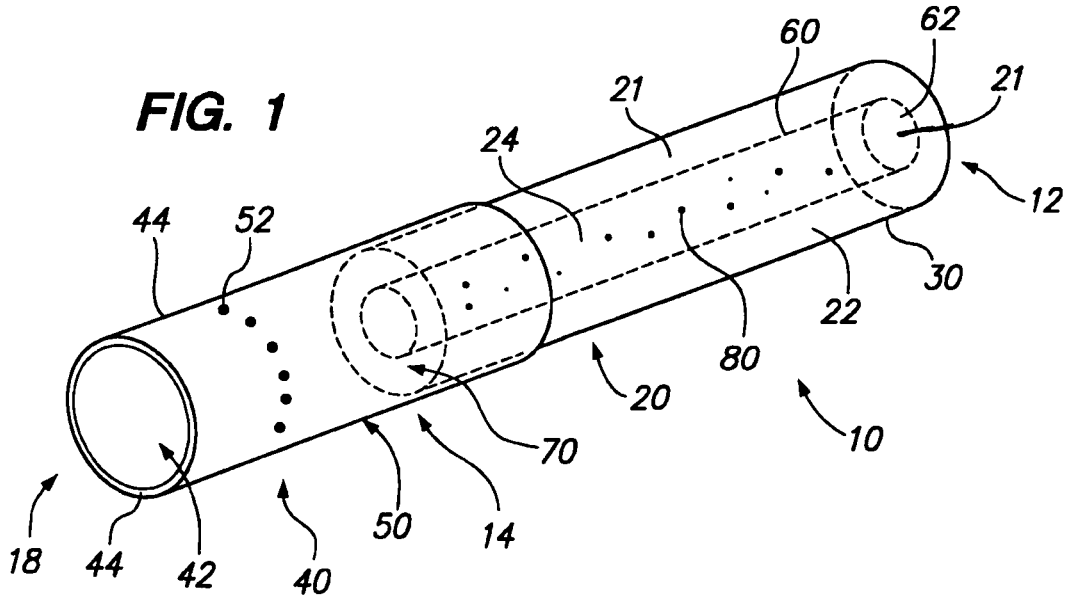
FIG. 1 is a perspective view of a smoking article having a coaxial tobacco rod with a gas-impermeable or semi-impermeable annular film on the tipped end of the tobacco rod.

FIG. 1 shows a smoking article 10 in the form of a cigarette. Smoking articles 10 in the form of cigarettes include a generally cylindrical tobacco rod 20 of smokable material 21, contained in a circumscribing outer wrapper 30. The outer wrapper 30 is a porous wrapping material or paper wrapper. The tobacco rod 20 has a lit end 12 and a tipped end 14. The smokable material 21 is preferably a shredded tobacco or tobacco cut filler. However, any suitable smokable material 21 can be used.

The smoking article 10 also includes a filter 40 adjacent to the tipped end 14 of the tobacco rod 20 such that the filter 40 and tobacco rod 20 are axially aligned in an end-to-end relationship, preferably abutting one another. The filter 40 has a generally cylindrical shape, and the diameter thereof is essentially equal to the diameter of the tobacco rod 20. The ends (i.e., upstream end 16 and downstream end 18) of the filter 40 are open to permit the passage of air and smoke therethrough. The "upstream" and "downstream" relative portions of the end of the filter 40 and other features described herein are described in relation to the direction of mainstream smoke as it is drawn from the tobacco rod 20 and through the filter 40.

The filter 40 includes a filter material 42 (e.g., cellulose-based, polypropylene, or plasticized cellulose acetate tow) circumscribed by a plug wrap 44. The filter material 42 also can have the form of a gathered web (e.g., polypropylene web, polyester web, cellulosic (paper) web or starch-based web). If desired, the filter material 42 can have at least one cavity, sleeve, sorbent, passage or groove (not shown) extending longitudinally therethrough or partially therethrough. The plug wrap 44 is preferably a paper which optionally may incorporate activated carbon or other adsorbent material. The plug wrap 44 circumscribes the total length of the filter 40.

The filter 40 is attached to the tobacco rod 20 by a tipping paper 50, which preferably circumscribes both the entire length of the filter 40 and an adjacent region of the tobacco rod 20. The tipping paper 50 is typically constructed from paper; however, any other suitable material can be used. A ventilated or air diluted smoking article is provided with an air dilution means, such as a series of ventilation holes or perforations 52, each of which extend through the tipping paper 50 and optionally the plug wrap.

In one embodiment, as shown in FIG. 1, the tobacco rod 20 comprises a cylindrical tube 22 of smokable material 21 and a concentric (central) rod 24 of smokable material 21. The concentric rod 24 of smokable material 21 is longitudinally and coaxially positioned within the cylindrical tube 22 of the tobacco rod 20. An inner wrapper 60 separates the cylindrical tube 22 and the concentric rod 24. The inner wrapper 60 circumscribes the concentric rod 24 of smokable material 21 and preferably extends the entire length of the concentric rod 24. In an alternative embodiment, the inner wrapper 60 extends only a portion of the length of the concentric rod 24.

In one embodiment, the inner wrapper 60 is made of a gas-impermeable or semi-impermeable material having impermeability or very low permeability to air or gas. The inner wrapper 60 preferably has a permeability of between 0 and 30 Coresta Units and more preferably between 0 and 5 Coresta Units. The gas-impermeable or semi-impermeable material can be, but is not limited to, reconstituted tobacco products or cellulose-based papers. It can be appreciated that any suitable gas-impermeable or semi-impermeable material can be used.

The smoking article 10 can also include an annular film 70 located between the filter 40 and the tipped end 14 of the tobacco rod 20. The annular film 70 is also preferably comprised of a gas-impermeable or semi-impermeable material having an impermeable or very low permeability to air or gas. The annular film 70 is preferably comprised of reconstituted tobacco products or cellulose-based papers. However, it can be appreciated that any suitable gas-impermeable or semi-impermeable material can be used for the annular film 70.

The annular film 70 provides an annular seal on the tipped end 14 of the cylindrical tube 22 of smokable material 21. The annular film 70 allows an increased portion of air to be drawn through the concentric rod 24. Meanwhile, the annular film 70 decreases or blocks the portion of air that is drawn through the cylindrical tube 22. Thus, the increased resistance-to-draw of the cylindrical tube 22 results in an increased quantity of smokable material 21 or tobacco combustion in the concentric rod 24 as compared to the cylindrical tube 22 of smokable material 21. In addition, an increased quantity of flavor or tar diluents can be delivered in the mainstream smoke via the concentric rod 24 of the smoking article 10 by increasing the resistance-to-draw of the smokable material within the cylindrical tube 22.

In one embodiment, the smokable material 21 of the concentric rod 24 can be impregnated with an additive 80 in the form of flavorants and/or tar diluents. The additives 80 can be in the form of liquid agents or volatile solids, such as liquid flavor compounds, aerosol formers, or menthol. The flavor and tar diluents 80 are preferably added to the smokable material 21 of the concentric tobacco rod 24, which is segregated from the cylindrical tobacco tube 22 by the gas-impermeable or semi-impermeable inner wrapper 60. It can be appreciated that the inner wrapper's 60 gas-impermeable or semi-impermeable properties minimizes the migration of flavor and tar diluents to the cylindrical tube 22 and the outer wrapper 30. In addition, spotting of the outer wrapper 30 is minimized by the inner wrapper 60. Furthermore, as a result of the increased resistance-to-draw on the cylindrical tube 22, a greater percentage of air is drawn through the concentric rod 24 enhancing the flavor and tar diluents of the smoking article 10. Thus, less flavor or aerosol formers are required because of a more efficient transfer of flavor and tar diluents and the minimal loss to the side-stream smoke (i.e. smoke from the lit end 12 of the smoking article 10) during the static burning of the smoking article 10.

As indicated, the smokable material 21 is preferably a shredded tobacco having a uniform blend or composition. Accordingly, the blend of smokable material 21 for the concentric rod 24 can be formulated to achieve a desired organoleptic attributes in the smoke. In addition, the blend of smokable material 21 for the cylindrical tube 22 can be formulated such that it helps reduce smoke constituents of the side stream smoke of the smoking article 10.

In another embodiment, the smoking article 10 has different blends or compositions of smokable material 21 within the cylindrical tube 22 and the concentric rod 24. Furthermore, by providing the smoking article 10 with different blends or compositions of smokable material 21 within the cylindrical tube 22 and the concentric rod 24, the smoking article 10 can control the tar concentration in the mainstream smoke. The smoking article 10 can also enhance the transfer of flavor and tar diluents by the inclusion of the additives 80 within the smokable material 21 of the concentric rod 24.

It can be appreciated that the permeability of the inner wrapper 60, the densities and the dimensions of the concentric rod 24 and cylindrical tube 22 and the composition of the smokable material 21 in the concentric rod 24 and cylindrical tube 22 can be varied to achieve the desired organoleptic attributes and smoke constituencies for both the mainstream and the side-stream smoke.

Figure 2:
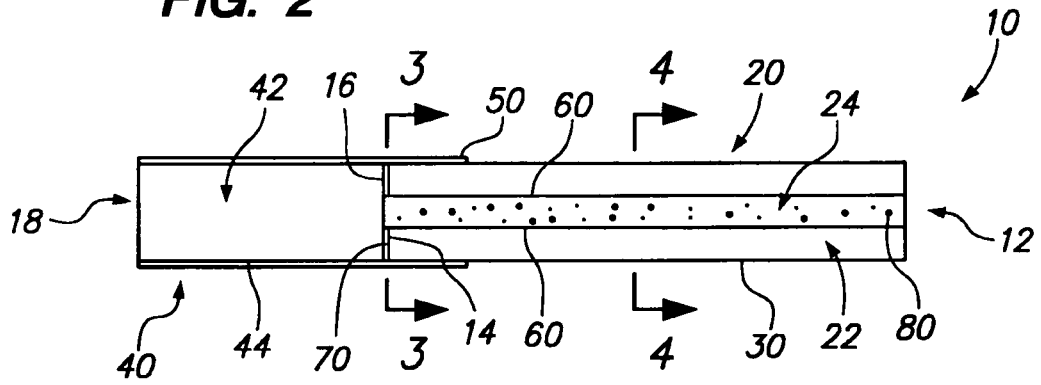
FIG. 2 is a cross sectional view of the smoking article of FIG. 1 having a coaxial tobacco rod with a gas-impermeable or semi-impermeable annular film on the tipped end of the tobacco rod.

FIG. 2 shows a cross sectional view of the smoking article of FIG. 1 having a coaxial tobacco rod 20 with a gas-impermeable or semi-impermeable annular film 70 on the tipped end 14 of the tobacco rod 20. As shown in FIG. 2, the lit-end 12 of the smoking article 10 is comprised of a cylindrical tobacco rod 20 portion that is between 6.0 and 10.0 millimeters in diameter and 40 millimeters and 125 millimeters in length. The tobacco rod 20 portion comprises a concentric rod 24 of smokable material 21, and a cylindrical tube 22 of smokable material 21 coaxially surrounding the concentric rod 24. The cylindrical tube 22 and concentric rod 24 are separated by the inner wrapper 60.

The concentric rod 24 within the cylindrical tube 22 of smoking material 21 preferably extends to the tipped end 14 of the tobacco rod 20. However, it can be appreciated that the concentric rod 24 does not necessarily extend to the tipped end 14 of the tobacco rod 20. As shown in FIG. 2, the tipped end 14 of the cylindrical tube 22 and concentric rod 24 are preferably aligned with and abut the filter 40.

The inner wrapper 60 also preferably extends the length of the tobacco rod 20 and is sealed at the tipped end 14 of the tobacco rod 20 with the annular film 70. The annular film 70 is positioned between the filter 40 and the tobacco rod 20, and is adapted to decrease airflow drawn through the cylindrical tube 22 by providing an annular seal on the cylindrical tube 22 of smokable material 21.

Figure 3:
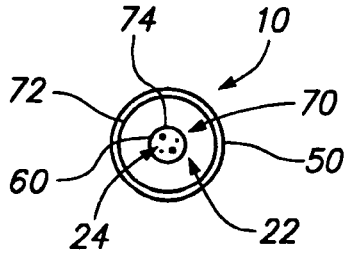
FIG. 3 is a cross sectional view of the smoking article of FIG. 1 along the line 3-3.

FIG. 3 shows a cross sectional view of the smoking article 10 of FIG. 1 along the line 3-3. As shown in FIG. 3, the annular film 70 is comprised of gas-impermeable or semi-impermeable material, such as reconstituted tobacco products or cellulose-based papers. It can be appreciated that the annular film 70 can be manufactured from any suitable material having gas-impermeable or semi-impermeable properties. The annular film 70 preferably has a thickness of 0.01 millimeters to 1.00 millimeters and more preferably 0.1 millimeters to 0.5 millimeters. In addition, the annular film 70 will have a permeability of between 0 and 30 Coresta Units and more preferably between 0 and 5 Coresta Units.

As shown in FIG. 3, the annular film 70 has an outer diameter 72, which is approximately equal to the outer diameter of the tobacco rod 20. The annular film 70 also has an inner diameter 74, which is approximately equal to the outer diameter of the concentric rod 24. The inner diameter 74 of the annular film 70 is preferably sized such that smoke or other byproducts of the smoking article 10 are unimpeded to the filter 40 of the smoking article 10. However, it can be appreciated that the annular film 70 can be made of any suitable material, which does not impede, or only partially impedes, the smoke or other by products of the tobacco rod 20. In addition, the permeability, the density, and the dimensions of the annular film 70 can be varied to achieve the desired organoleptic properties and the constituencies for both the mainstream and the side-stream smoke. The inner diameter 74 is preferably between 2.0 and 7.0 millimeters. Meanwhile, the outer diameter 72 will preferably be between 6.0 and 10 millimeters.

Figure 4:
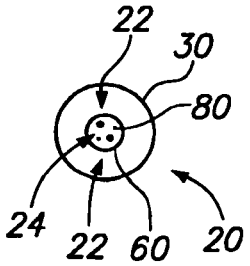
FIG. 4 is a cross sectional view of the smoking article of FIG. 1 along the line 4-4.

FIG. 4 shows a cross sectional view of the smoking article 10 of FIG. 1 along the line 4-4. As shown in FIG. 4, the tobacco rod 20 of the smoking article along line B-B comprises the concentric rod 24 of smokable material 21 surrounded by the gas-impermeable or semi-impermeable inner wrapper 60. The cylindrical tube 22 of smokable material 21 surrounds the inner wrapper 60. The outer wrapping material 30 circumscribes the cylindrical tube 22 forming the tobacco rod 20. As shown in FIG. 4, the concentric rod 24 has an outer diameter of between 2.0 millimeters and 7.0 millimeters. Meanwhile, the cylindrical tube 22 will have an outer diameter of between 6.0 millimeters and 10.0 millimeters. The wrapper 60 can be conventional paper having a thickness of between 0.01 and 1.0 millimeters or a paper having a reduced permeability of between 0 and 5 Coresta Units.

The smoking article 10 as described herein can be manufactured using any suitable process. Suitable processes include the formation of coaxial cylindrical tube 22 via the extrusion of an annular sheath around a preformed concentric rod 24. In operation, a preformed smokable material 21 in the form of a shredded tobacco in a continuous cylindrical form or concentric rod 24 is fed through the middle of an extrusion head where tobacco and binders are being fed to form the cylindrical tube 22. Alternatively, the preformed concentric rod 24 is fed through a garniture where the smokable material is also fed and rolled around to form the cylindrical tube 22 segment of the tobacco rod 20. It can be appreciated that the smoking article 10 appears like a traditional cigarette but provides the smoking characteristics of a slim or ultra slim cigarette.

It will be understood that the foregoing description is of the preferred embodiments, and is, therefore, merely representative of the article and methods of manufacturing the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:
- a tobacco rod comprising:
  - a cylindrical tube of smokable material having an outer wrapper;
  - a concentric rod of smokable material coaxially positioned within the cylindrical tube of a smokable material; and
  - a semi-impermeable inner wrapper separating the cylindrical tube and the concentric rod;
- a filter attached to the tobacco rod; and
- an annular film on a tipped end of the cylindrical tube of smokable material and which is positioned between the filter and the tobacco rod, wherein the annular film increases a resistance-to-draw through the cylindrical tube as compared to a resistance-to-draw through the concentric rod.

2. The smoking article of claim 1, wherein the annular film is gas-impermeable.

3. The smoking article of claim 1, wherein the annular film is semi-impermeable.

4. The smoking article of claim 1, wherein the smokable material is a shredded tobacco.

5. The smoking article of claim 1, wherein the smokable material of the cylindrical tube is a shredded tobacco, which is impregnated with an additive.

6. The smoking article of claim 5, wherein the additive is a liquid agent, a volatile solid, a liquid flavored compound, an aerosol former or a menthol forming substance.

7. The smoking article of claim 1, wherein the concentric rod extends to a juncture of said filter and the cylindrical tube of smoking material.

8. The smoking article of claim 1, wherein the smokable material of the cylindrical tube has a different composition than the smokable material of the concentric rod.

9. The smoking article of claim 1, wherein the annular film has an outer diameter, which is approximately equal to an outer diameter of the tobacco rod, and the annular film has an inner diameter approximately equal to an outer diameter of the concentric rod.

10. The smoking article of claim 1, wherein the annular film has an inner diameter, which is sized such that smoke or other byproducts of the concentric rod of the smoking article are unimpeded to the filter of the smoking article.

11. The smoking article of claim 1, wherein the annular film has a thickness of approximately 1.0 millimeter or less.

12. The smoking article of claim 1, wherein the annular film has a thickness of approximately 0.1 to 0.5 millimeters.

13. A smoking article comprising:
- a tobacco rod comprising:
  - a cylindrical tube of smokable material having an outer wrapper;
  - a concentric rod of smokable material coaxially positioned within the cylindrical tube of a smokable material; and
  - a semi-impermeable inner wrapper separating the cylindrical tube and the concentric rod;
- a filter attached to the tobacco rod; and
- a semi-impermeable annular film on a tipped end of the cylindrical tube of smokable material and which is positioned between the filter and the tobacco rod, and wherein the annular film increases a resistance-to-draw through the cylindrical tube as compared to a resistance-to-draw through the concentric rod.

14. The smoking article of claim 13, wherein the smokable material of the cylindrical tube is impregnated with an additive.

15. The smoking article of claim 14, wherein the additive is a liquid agent, a volatile solid, a liquid flavored compound, an aerosol former or a menthol forming substance.

16. The smoking article of claim 13, wherein the concentric rod extends to a juncture of said filter and the cylindrical tube of smoking material.

17. The smoking article of claim 13, wherein the smokable material of the cylindrical tube has a different composition than the smokable material of the concentric rod.

18. The smoking article of claim 13, wherein the annular film has an outer diameter, which is approximately equal to an outer diameter of the tobacco rod, and the annular film has an inner diameter approximately equal to an outer diameter of the concentric rod.

19. The smoking article of claim 13, wherein the annular film has an inner diameter, which is sized such that smoke or other byproducts of the concentric rod of the smoking article are unimpeded to the filter of the smoking article.

20. The smoking article of claim 13, wherein the annular film has a thickness of approximately 1.0 millimeter or less.

21. The smoking article of claim 13, wherein the annular film has a thickness of approximately 0.1 to 0.5 millimeters.

* * * * *